United States Patent [19]

Pryor et al.

[11] 4,214,654

[45] Jul. 29, 1980

[54] COIN TRANSFER MEANS FOR VENDORS

[75] Inventors: Harry H. Pryor, Crestwood; Calvin L. Chumley, St. Louis County, both of Mo.

[73] Assignee: UMC Industries, Inc., Stamford, Conn.

[21] Appl. No.: 863,122

[22] Filed: Dec. 22, 1977

[51] Int. Cl.[2] ..... G07F 1/04

[52] U.S. Cl. ..... 194/1 E; 194/1 K

[58] Field of Search ..... 194/1 E, 1 K, 1 F, 1 G, 194/DIG. 1, DIG. 2, 2, 4, 10, 4 C, 4 E, 4 R; 133/3 F, 3 H, 4 R, 2; 232/18, 12

[56] References Cited

U.S. PATENT DOCUMENTS

| | | | |
|---|---|---|---|
| 3,245,419 | 4/1966 | Manning et al. | 133/2 |
| 4,046,243 | 9/1977 | Valentine | 194/10 |

*Primary Examiner*—Stanley H. Tollberg

*Attorney, Agent, or Firm*—Senniger, Powers, Leavitt and Roedel

[57] ABSTRACT

Coin transfer apparatus for vendors enabling handicapped persons in wheel chairs to utilize the vendors, adapted to receive coins at a level within reach of a person in a wheel chair and acting automatically in response to deposit of coins to transfer the coins to a level above the coin controlled apparatus of the vendor, the coins then gravitating down to the coin controlled apparatus in the vendor.

31 Claims, 8 Drawing Figures

COIN TRANSFER MEANS FOR VENDORS

BACKGROUND OF THE INVENTION

This invention relates to coin transfer means for vendors, and more particularly to such means for enabling handicapped persons in wheel chairs to use the vendors.

Handicapped persons in wheel chairs are unable to use many vendors now in service because the coin slots of the vendors are above their reach. For example, as to vendors sold by National Vendors Division of UMC Industries, Inc., assignee of this application, which are 72 inches high, the coin slot is located 58¾ inches from the floor, which is too high for a person seated in a wheel chair to reach. The slot is located at such an elevation so that coins inserted in the slot may descend by gravity through a coin handling unit (including a slug rejector) to a money box (or to change tubes) with provision for gravity delivery of slugs from the slug rejector and coins from escrow (or change from the change tubes) to a return cup with the cup at a level (approximately 27 inches above the floor) which may be reached without undue stooping. Lowering the coin handling unit is generally infeasible because it would unduly lower the return cup and, in certain instances, because of structural conflict within the vendor.

SUMMARY OF THE INVENTION

Among the several objects of the invention may be noted the provision of coin transfer means for vendors enabling handicapped persons in wheel chairs readily to deposit coins for obtaining a vend; the provision of such coin transfer means enabling insertion of coins at a level readily within the reach of a person seated in a wheel chair and acting automatically to deliver the coins to the usual coin handling means of the vendor, said coin handling means being at the usual elevation in the vendor for receiving coins deposited in the vendor for descent of coins therethrough by gravity; the provision of such coin delivery means readily applicable as a unit to an existing vendor having a coin slot at a level not readily within reach of a person seated in a wheel chair to adapt the vendor for insertion of coins at a level readily within reach of a person seated in a wheel chair; and the provision of such coin delivery means useful in original equipment for insertion of coins at a level readily within reach of a person seated in a wheel chair while retaining the usual location of the coin handling means and return cup.

In general, the invention involves the provision of a vendor, which basically comprises dispensing means and coin controlled means for controlling said dispensing means, and means for guiding coins to said coin controlled means, said guide means having an inlet at an upper level above said coin controlled means, coins entering the guide means through said inlet gravitating down from said inlet to said coin controlled means, with coin transfer means for receiving coins at a level below said upper level, elevating them to said upper level, and entering them in said upper level inlet.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
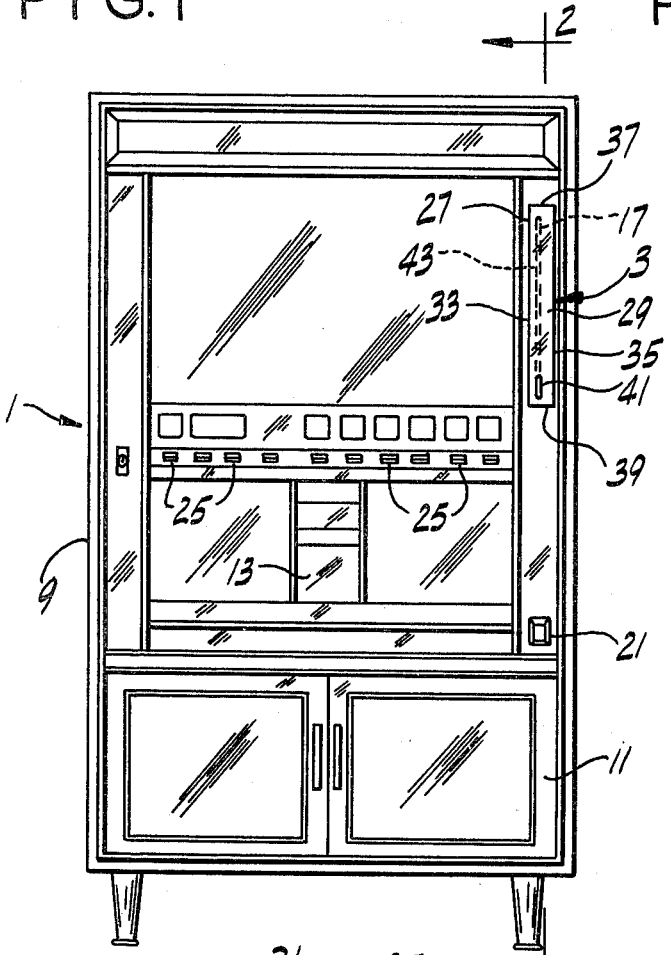
FIG. 1 is a front elevation of a vendor equipped with a coin transfer means in accordance with this invention.
Figure 2:
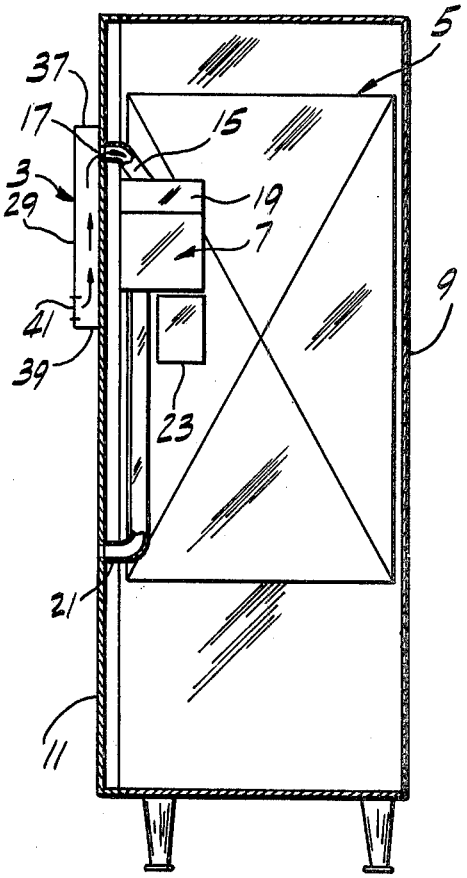
FIG. 2 is a vertical section generally on line 2—2 of FIG. 1 showing certain internal detail.

Referring to the drawings, there is generally indicated at 1 in FIG. 1 a vendor provided in accordance with this invention with coin transfer means generally designated 3. The vendor 1, as illustrated, is a hot beverage vendor of a type such as is presently manufactured and sold by National Vendors Division of UMC Industries, Inc., of St. Louis, Missouri, assignee of the invention. For purposes of understanding the present invention, it will suffice to say that the vendor comprises dispensing means indicated at 5 in FIG. 2 under control of a coin controlled means indicated at 7 in a cabinet 9 having a front door 11. For the hot beverage vendor illustrated, the dispensing means would include means for brewing a cup of coffee, means for dispensing a cup to a delivery station 13, means for dispensing sugar and a cream product into the cup of coffee, means for dispensing hot chocolate, and other selections, typical of hot beverage machines. The coin controlled means 7 is that conventionally used in National Vendors' said vendor. It controls the dispensing means in response to receipt of coins delivered thereto via a coin guide means 15 from the coin slot 17 of the vendor, this slot being in the front door 11 of the vendor at the right. In the case of National Vendors' 72-inch-high line of vendors, slot 17 is 58¾ inches above the floor. Coins inserted in the slot 17 are guided by the guide means 15 to a slug rejector 19 at the top of the coin controlled means which rejects slugs and returns them to a return cup 21 in the front door 11 at an elevation well below the slot 17 (approximately 27 inches above the floor in the case of National Vendors' 72-inch-high line of vendors). Genuine coins pass through the slug rejector to means in the coin controlled means 7 for totalizing the amount deposited and controlling the operation of the dispensing means in accordance therewith. The coin controlled means 7 may have a a change-making function, and include nickel and dime change tubes (not shown) for holding nickels and dimes for making change. Nickels and dimes pass to the nickel and dime tubes, if they are not full, and to a money box 23 when the tubes are full. Change is delivered to the return cup 21. The coin controlled means 7 may have an escrow function, for escrowing coins until a purchase is made or the customer actuates a return means for releasing coins from escrow, the coins being delivered to the return cup 21. Push buttons for making the selection for vending are indicated at 25 in FIG. 1.

The coin slot 17 constitutes a coin inlet at an upper level above the coin controlled means 7, coins entering the slot or inlet 17 gravitating down through the guide means 15 to the slug rejector 19, thence through the coin controlled means 7, and thence to the money box 23 or the change tubes (not shown). The coin delivery means 3 receives coins at a lower level (e.g., 48 inches above the floor) below the said upper level (which is 58¾ inches, for example, above the floor), elevates them to the coin slot or inlet 17 at the upper level, and enters them in the latter.

As shown in FIGS. 1–5, the coin transfer means 3 comprises an elongate housing designated in its entirety by the reference numeral 26 suitably secured in position extending vertically on the front of the front door 11 of the vendor with its lower end portion at a level within easy reach of a person seated in a wheel chair and its upper end portion in front of the coin slot 17 of the vendor. The housing has a front wall 29, a back wall 31, left and right side walls 33 and 35, and upper and lower end walls 37 and 39. In the front wall 29 adjacent the lower end of the housing is a vertical coin slot 41 adapted for insertion of coins of all the denominations which the coin controlled means 7 is to accept, e.g., nickels, dimes and quarters. This slot 41 constitutes a lower inlet for entry of coins at a level within easy reach of a person seated in a wheel chair, being located 48 inches above the floor, for example. Means indicated generally at 43 is provided in the housing 27 for moving coins entered in the coin slot or inlet 41 up to the level of the original coin slot 17 of the vendor (at the 58¾ inch level, for example). Means such as indicated at 45, and more particularly a vertical slot in the back wall 31 of the housing 27 in register with the original coin slot 17 of the vendor, is provided for passage of a coin reaching the level of slot 17 into the slot 17 at the level thereof (which may be referred to as the upper level).

Figure 3:
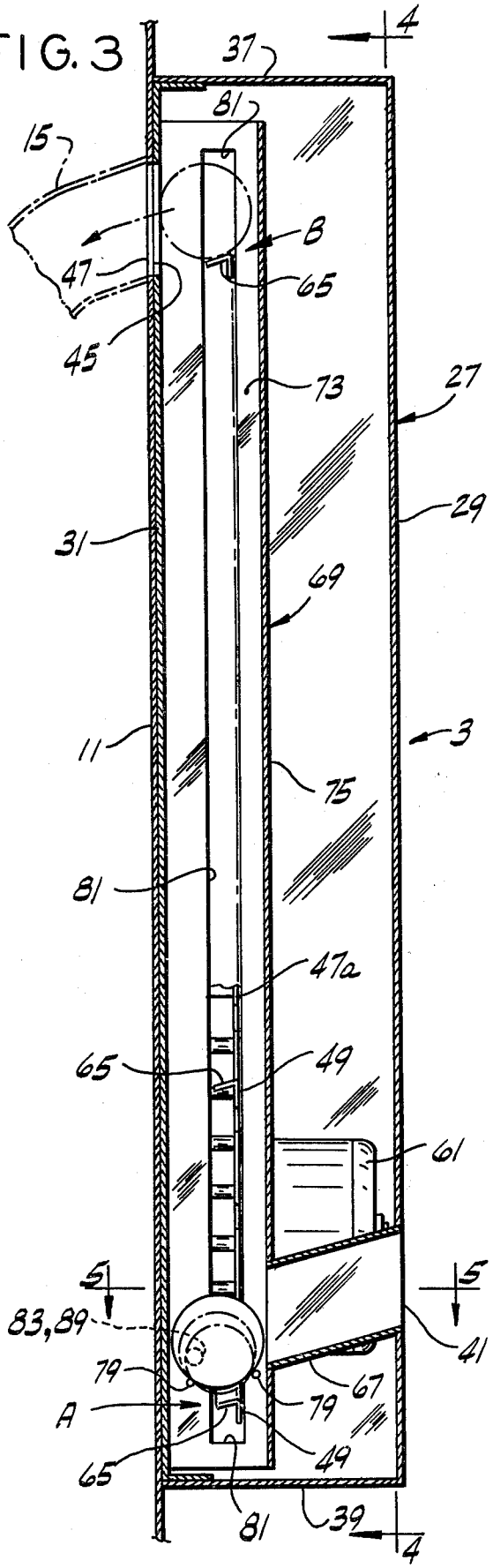
FIG. 3 (sheet 2) is a vertical section of the coin transfer means.
Figure 4:
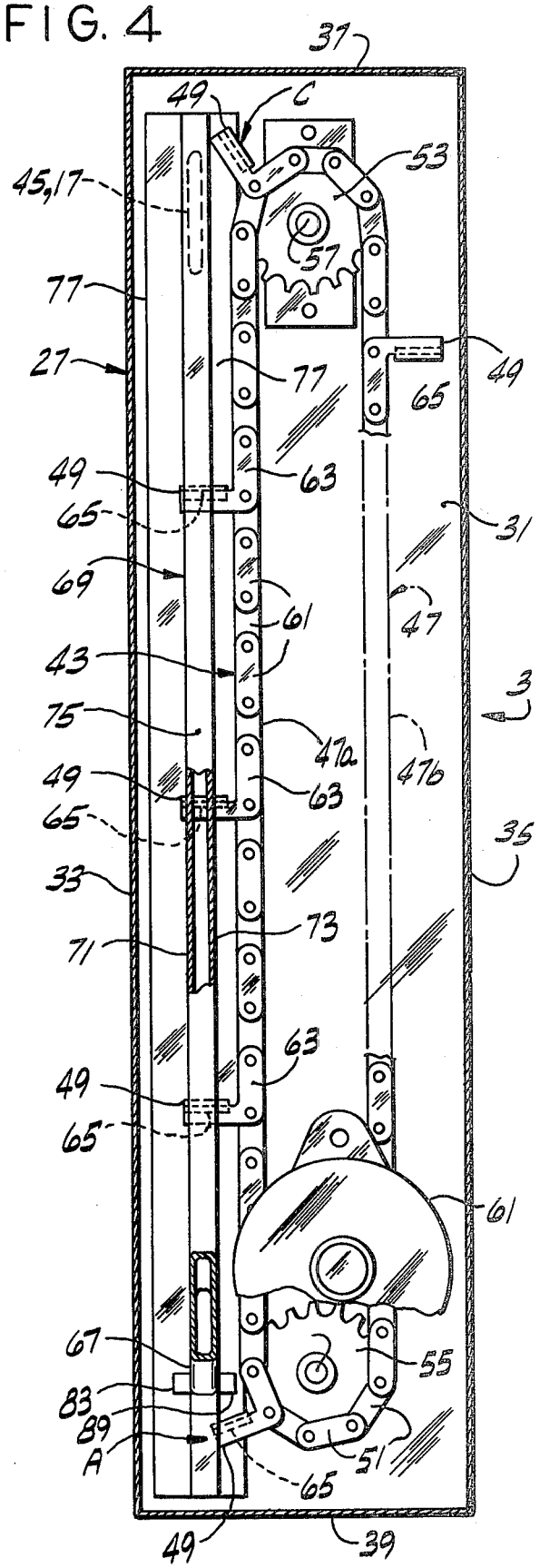
FIG. 4 (sheet 2) is a vertical section on line 4—4 of FIG. 3.

The coin moving means 43 of FIGS. 3 and 4 comprises an endless conveyor generally designated 47 having a series of coin lifters 49 spaced at equal intervals thereon. This endless conveyor comprises an endless chain, the individual links of which are indicated at 51, with means constituted by upper and lower sprockets 53 and 55 in the housing 27 at its upper and lower ends guiding the endless chain for travel in an endless path including an upwardly movable left side reach **47*a* (left as viewed from the front) and a downwardly movable right side return reach 47*b*. The sprockets are mounted on upper and lower shafts 57 and 59 which extend horizontally in front-to-rear direction in the housing 27 adjacent its upper and lower ends. An electric motor 61** (a gearmotor) is provided in the housing for driving the chain.

Each of the coin lifters 49 on the chain 47 comprises an arm extending out from the chain in a plane parallel to the plane of the chain at one side of the chain, the arm being part of a sheet metal stamping having a body portion 63 fastened on the side of the chain on the outside of a link of the chain by means of the pins which secure this link to the two adjacent links. Extending laterally from the arm is a coin-supporting finger 65 which, as appears in FIG. 3, is inclined with respect to the arm. The coin slot or inlet 41 in the front 29 of the housing 27 (which is located toward the left side of the housing) provides for entry of coins up to the largest diameter coin to be handled (e.g., quarters) to an inclined coin guide or chute 67 which slopes down from the front toward the back of the housing to the lower end of a vertical coin guideway 69 extending from adjacent the lower end to adjacent the upper end of the housing. This guideway 69, which is located in the housing 27 at the back of the housing, is of channel shape in horizontal cross section (see FIG. 5) having left and right flanges forming side walls 71 and 73 spaced apart a distance somewhat greater than the thickness of the coin of greatest thickness to be handled (e.g, a nickel), a web forming a front wall 75 extending between the side walls, and lips 77 at the back of the side walls by means of which the channel is secured to the back wall 31 of the housing 27. The latter forms the back wall of the guideway 69 up to the slot 45 in register with the original coin slot 17 of the vendor. Pins such as indicated at 79 extend between the side walls 71 and 73 of the guideway at a level just below the level of the inner end of the bottom of the chute 67 for cradling a coin which has rolled down the chute 67 into the guideway.

The lifter fingers 65 on the upwardly movable left side reach **47*a* of the chain extend into the guideway 69 through a vertical slot 81 in the right side wall 73 and out through a similar slot in the left side wall 79 of the guideway, these slots extending from adjacent the lower end to the upper end of the guideway. The arrangement is such that as each lifter finger 65 comes around the bottom of the sprocket 55 and up on the left side of this sprocket, it enters the slots 81, and by the time it reaches a position such as indicated at A in FIGS. 3 and 4 somewhat below the pins 79 it extends into the guideway 67 from the right toward the left side of the guideway, the finger being inclined downwardly from the front to the back of the guideway. The pins 79 are located on opposite sides of the slots 81. Thus, with the chain at rest, and with a lifter finger 65 at position A, which may be referred to as the lifter starting position, a coin inserted in the slot 41 in the front of the housing 27 will roll down in the chute 67 and into the lower end portion of the guideway 69, where it becomes supported on the pins 79. FIG. 3 shows how coins of the different denominations (and sizes), e.g., nickels, dimes and quarters, are cradled on the pins. The lifter finger 65** at the starting position A underlies the coin on the pins.

Each finger 65 is movable from its said starting position A up through a position B at the level of the bottom of the slots 45 and 17 for elevating the coin to the level of these slots and entering the coin in the original coin slot or inlet 17 of the vendor, to a position such as indicated at C in FIG. 4. This entry of the coin in slot 17 occurs when the finger 65 reaches position B due to the inclination of the finger, the coin then rolling down off the finger through the slots 45 and 17 as indicated in FIG. 3.

Figure 5:
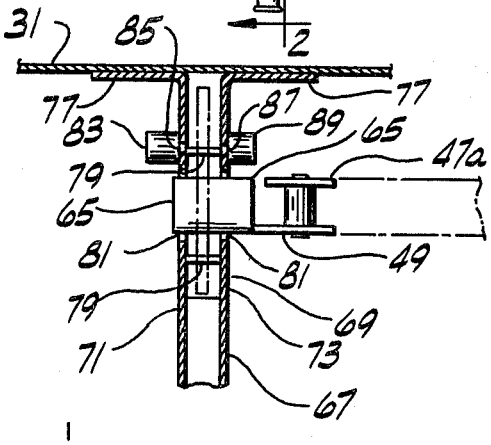
FIG. 5 (sheet 1) is a horizontal section on line 5—5 of FIG. 3.
Figure 6:
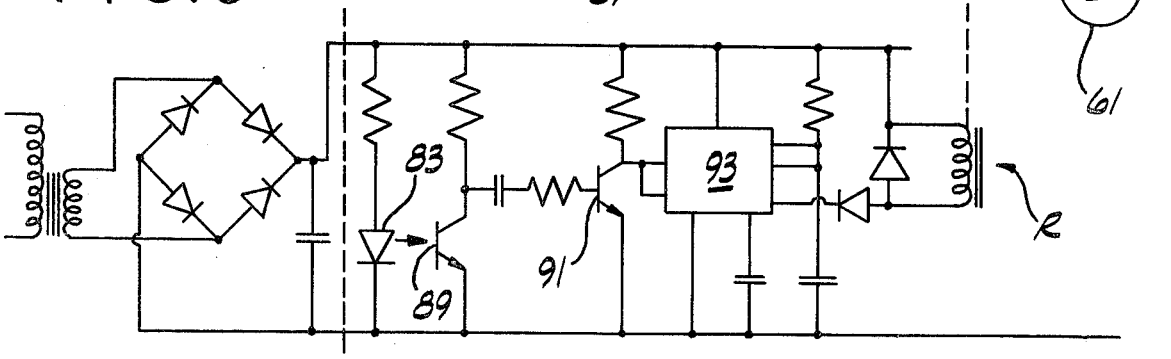
FIG. 6 (sheet 1) is a wiring diagram.

The fingers 65 are spaced at unit intervals of about 2.5 inches, for example. Position C is four unit intervals (ten inches), for example, from position A, and beyond position B with respect to the direction of travel of the chain. Operation of the motor 61 to drive the chain to lift a coin is initiated by means responsive to delivery of a coin via the chute 67 to the lower end of the guideway 69 (i.e., responsive to deposit of a coin in the slot 41 at the lower end of the housing 27). This means comprises a light source such as a light-emitting diode (LED) 83 on one side of the guideway 69 (its left side 71 as illustrated in FIG. 5) which directs a beam of light through a window 85 in this side of the guideway through a window 87 in the other side of the guideway to a phototransistor 89 on the other side of the guideway. The windows, the LED and the phototransistor are located for interception of the beam of light by any coin on the pins 79 as will appear from FIGS. 3 and 5. On interruption of the beam by a coin, the phototransistor 89 delivers a positive pulse to a transistor 91 (see FIG. 6), which inverts this pulse to deliver a negative pulse to a timer 93. The latter controls a relay R having a set of contacts R1 in a circuit 95 for the motor 61. The relay is normally energized and its contacts R1 are normally open as shown in FIG. 6. When the timer 93 is activated by the stated negative pulse, it initiates a time cycle during which it de-energizes the relay for closure of contacts R1 to energize the motor. At the end of the time cycle (25 seconds, for example), the relay is re-energized to open the contacts and stop the motor. The timer is of a well-known type which is operable on each delivery of a negative pulse thereto (in response to interruption of the light beam by a coin) to start the time cycle. The duration of the time cycle, and the resultant period of operation of the motor 61, is such as to effect driving of the chain 47 to move a lifter finger 65 from position A to position C, another lifter finger coming into position A for the next cycle.

In the operation of the vendor 1 with the coin transfer means, whenever a coin is inserted in the slot 41, it rolls down the chute 67 into the lower end of the guideway 69 and onto the pins 79. The slot 41 is at a level above the floor (e.g., 48 inches above the floor), readily within the reach of a purchaser seated in a wheel chair, as well as being conveniently within reach of purchasers standing at the vendor. When the coin reaches the pins 79, in intercepts the beam of light from the LED 83 to the phototransistor 89. The latter thereupon delivers a positive pulse to transistor 91 which in turn delivers a negative pulse to the timer 93, thereby to de-energize the relay R for closure of the contacts R1 in the motor circuit 95. The motor 61 is thereupon energized to drive the chain 47. The coin lifter finger 65, which was in the starting position A, moves up with the upwardly moving left-hand reach 47*a* of the chain and, engaging the bottom of the coin on the pins, passes up between the pins and lifts the coin, with the coin on edge in the plane of the guideway 69 and guided in the latter as it is lifted. The coin continues to be lifted by the finger until the finger reaches position B, at which point the coin rolls off the finger through the slots 45 and 17 into the coin guide means 15 of the vendor, which delivers the coin by gravity to the coin controlled means 7 of the vendor. The finger continues to move up with the chain to position C, at which point the timer 93 energizes the relay R to open the contacts R1 and de-energize the motor 61. Each additional coin which may be inserted in slot 41 while a previously inserted coin is being lifted re-starts the time cycle of timer 93, so that the motor 61 continues in operation until the last coin has been lifted by a finger to position B and that finger has continued on to position C.

Figure 7:
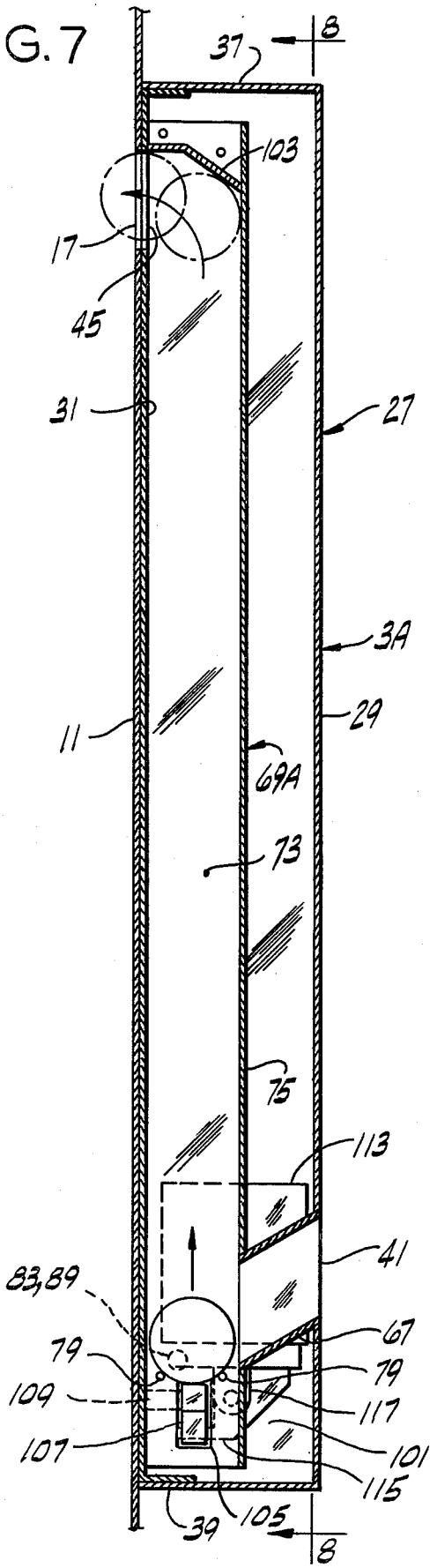
FIG. 7 (sheet 3) is a view similar to FIG. 3 showing a second embodiment of the coin transfer means.
Figure 8:
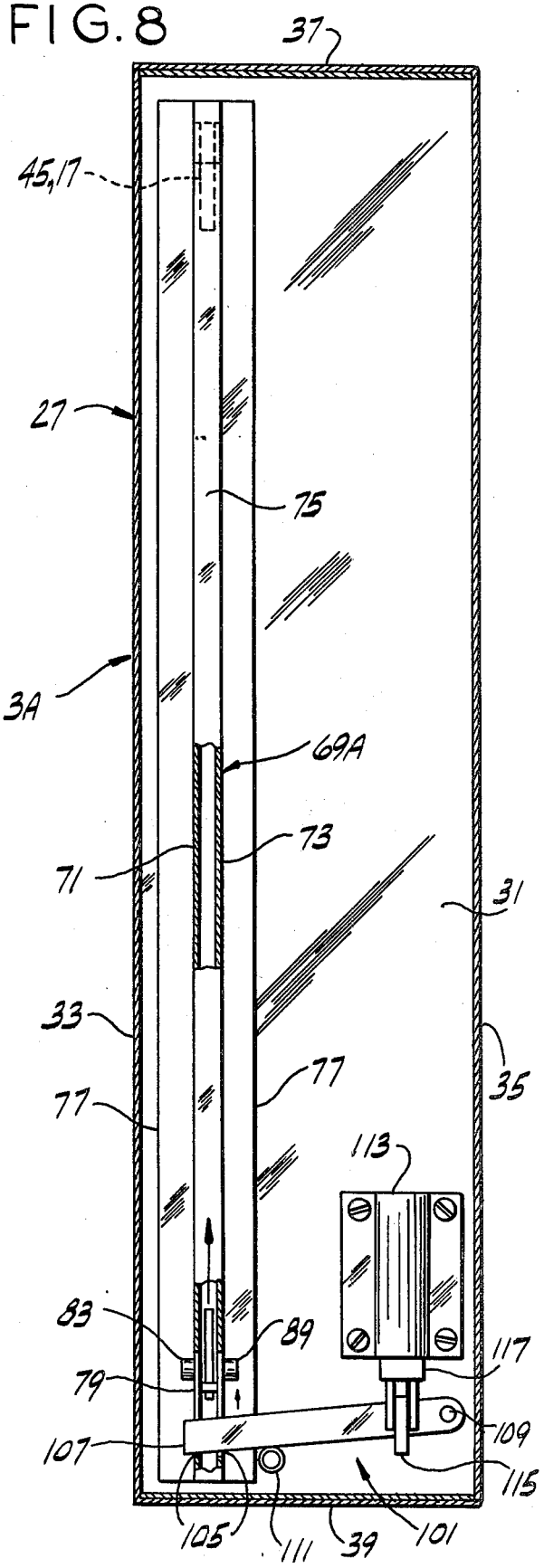
FIG. 8 (sheet 3) is a vertical section generally on line 8—8 of FIG. 7, with parts further broken away and shown in section.

FIGS. 7 and 8 show a modification 3A of the coin transfer means 3, and one which may be presently preferred over the latter, in which the coin moving means comprises means indicated generally at 101 for shooting a coin entered in the slot 41 up in a guideway 69A to the level of the slots 45 and 17, the coin being deflected through these slots into the coin guide means 15 by a deflector 103 at the upper end of the guideway. The coin transfer means 3A comprises a housing 27 generally the same as that shown in FIGS. 3 and 4 with the slot 41 on its front wall 29 and the slot 45 in its back wall 31 in register with the original coin slot 17 of the vendor. The guideway 69A is similar to the guideway 69 except that it has relative short vertical slots 105 in its sides 71 and 73 adjacent its lower end instead of the long slots 81.

The shooting means comprises a coin impeller or kicker 107 constituted by a lever pivoted at 109 on the back 31 of the housing 27 adjacent the right side of the housing and adjacent the lower end of the housing, the lever extending from the pivot 109 toward the left in the housing through the slots 105 in the guideway. The lever normally occupies the lowered retracted position in which it is shown in solid lines in FIG. 8 in engagement with a stop 111. In this retracted position of the lever, its free end portion is somewhat below the pins 79, which are on opposite sides of the slots 105. The lever is adapted rapidly to be swung up to impel a coin upwardly in the guideway 69A by means of a solenoid 113 having a hook 115 on the lower end of its plunger 117 hooked under the lever. The arrangement is such that on energization of the solenoid, plunger 117 is snapped up to snap up the lever. On de-energization of the solenoid, the plunger drops, and the lever swings back down to its retracted position.

A coin entered in the slot 41 rolls down chute 67 into the guideway 69A and on to the pins 79 above the free end portion of lever 107 which extends across the guideway. The coin interrupts the beam of light from the LED 83 to the phototransistor 89, generally the same as in the embodiment of FIGS. 3–6, and this results in energization of the solenoid 113 rapidly to swing the lever upwardly to kick the coin up in the guideway. Circuitry similar to that shown in FIG. 6 may be used with the solenoid 113 taking the place of the motor 61, and being energized on de-energization of the relay R to close the contacts R1. The timer 93 here would be set for a much shorter time interval, e.g., a fraction of a second, or another suitable control may be used in place of the timer 93 for energizing the solenoid for a fraction of a second. The coin, kicked up in the guideway 69A, strikes the deflector 103 at the upper end of the guideway, which may be constituted simply as an angled upper end wall member for the guideway, and bounces off the deflector through the slots 45 and 17 into the coin guide means 15 of the vendor.

While the coin transfer means 3 and 3A are herein shown as used in conjunction with existing vendors to adapt the vendors for insertion of coins at a level readily within reach of a person seated in a wheel chair, it will be understood that the principles of these coin lifters may be utilized in original equipment for insertion of coins at such a level while retaining the usual location of the coin handling means and return cup of the vendors.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A vendor comprising dispensing means, coin controlled means for controlling said dispensing means, and guide means for guiding coins to said coin controlled means, said guide means having an inlet at an upper level above said coin controlled means, coins entering the guide means through said inlet gravitating down from said inlet to said coin controlled means, and coin transfer means for receiving coins at a level below said upper level, elevating them to said upper level, and entering them in said upper level inlet, said coin transfer means comprising a lower inlet for entry of coins therein at said lower level, a conveyor having a coin lifter thereon, said conveyor being movable to carry the lifter through a path extending from the lower inlet to the upper inlet, the lifter being movable with the conveyor to a starting position wherein it underlies a coin deposited for a desired vend in the coin transfer means through said lower inlet, and means for driving the conveyor for upward travel through said path for lifting of said coin by the lifter up to said upper level, said coin then moving off the lifter and passing into the upper level inlet for said desired vend.

2. A vendor as set forth in claim 1 having means responsive to entry of a coin in said lower inlet for operating said driving means to drive the conveyor through a cycle in which the lifter moves up from its starting position to said upper level.

3. A vendor as set forth in claim 1 wherein said conveyor is an endless conveyor having a series of coin lifters spaced at intervals thereon, said coin transfer means further comprising means guiding the conveyor for travel in an endless path including an upwardly movable reach extending from the lower inlet to the upper inlet and a downwardly movable return reach.

4. A vendor as set forth in claim 3 having means responsive to entry of a coin in said lower inlet for operating said driving means to drive the conveyor through a cycle in which a lifter moves up from its said starting position to and beyond said upper level.

5. A vendor as set forth in claim 1 wherein the lower coin inlet is a vertical coin slot at the front of the vendor and said lifters are adapted for lifting the coins in a position wherein they extend edgewise generally in a vertical plane coplanar with said slot, the coin transfer means including a coin chute inclined downwardly from said coin slot for delivering coins inserted in the slot to said conveyor.

6. A vendor as set forth in claim 1 wherein the lifter is adapted to support a coin on edge and is so inclined that a coin on the lifter may roll down off the lifter into the inlet at the upper level.

7. A vendor comprising dispensing means, coin controlled means for controlling said dispensing means, and guide means for guiding coins to said coin controlled means, said guide means having an inlet at an upper level above said coin controlled means, coins entering the guide means through said inlet gravitating down from said inlet to said coin controlled means, and coin transfer means for receiving coins at a level below said upper level, elevating them to said upper level, and entering them in said upper level inlet, said coin transfer means having a lower inlet for entry of coins therein at said lower level, means for moving coins entered in said lower inlet up to said upper level, and means at said upper level for passage of a coin reaching said upper level into the said upper level inlet, said coin moving means comprising means for shooting a coin entered in said lower inlet up to said upper level.

8. A vendor as set forth in claim 7 wherein the means at said upper level for passage of a coin into said upper level inlet comprises a deflector for deflecting a coin shot upward by said shooting means into said upper level inlet.

9. A vendor as set forth in claim 8 having means operable on entry of a coin in said lower inlet for operating said shooting means.

10. A vendor as set forth in claim 8 wherein the lower coin inlet is a coin slot at the front of the vendor and the coin transfer means comprises a guideway for guiding coins inserted in said slot up to said upper level, said guideway guiding the coins edgewise generally in a vertical plane coplanar with said slot, said deflector being at the upper end of said guideway.

11. A vendor as set forth in claim 10 wherein the coin transfer means includes a coin chute inclined downwardly from said coin slot to said guideway.

12. A vendor as set forth in claim 11 having means operable on entry of a coin in said slot for operating said shooting means.

13. A vendor as set forth in claim 12 wherein the shooting means comprises a coin impeller extending across the guideway rapidly movable upwardly from a lowered retracted position to impel a coin thereon upwardly in the guideway, and means for rapidly moving the impeller upwardly.

14. A vendor as set forth in claim 13 wherein the impeller comprises a kicker and the means for moving the kicker comprises a solenoid in the housing having a plunger operable on the kicker.

15. A vendor as set forth in claim 13 wherein the guideway has pins for cradling a coin rolling down the chute into the guideway, the kicker, in its retracted position, being below the pins and being adapted to be moved up between the pins to kick the coin.

16. A vendor as set forth in claim 15 wherein the means operable on entry of a coin in said slot comprises means for emitting a beam of light across the guideway to a sensor with the beam interrupted by a coin rolling on the pins.

17. Coin transfer means adapted for use on the front of a vendor for transferring coins from a level within reach of a person seated in a wheel chair to the coin slot of the vendor at a higher level, said transfer means comprising an elongate housing having a front wall and a back wall, a coin slot in the front wall adjacent one end of the housing constituting its lower end, and a coin slot in the back wall adjacent its other and upper end, said housing being adapted to be mounted in generally vertical position on the front of the vendor with the slot in its back wall adjacent its upper end in register with the slot of the vendor, and with the coin slot in its front wall adjacent its lower end at a level within reach of a person seated in a wheel chair, and means in the housing for lifting a coin inserted in the coin slot in the front wall of the housing up to the level of the slot in the back wall of the housing and causing the coin to pass through the slot in the back wall into the coin slot of the vendor, said lifting means comprising an endless conveyor having a series of coin lifters spaced at intervals thereon, means guiding the conveyor for travel in an endless path in the housing including an upwardly movable reach extending from adjacent the lower end of the housing to adjacent the upper end of the housing and a downwardly movable reach, each lifter being movable with the conveyor to a starting position wherein it underlies a coin deposited in the housing through the coin slot in the front wall of the housing, and means for driving said conveyor for upward travel of its upwardly movable reach for lifting of a coin by a lifter up to the level of the slot in the back wall of the housing, said coin then moving rearward off the lifter and passing through said slot in the back wall, means operable on entry of a coin in the coin slot in the front wall of the housing for operating the driving means to drive the conveyor through a cycle in which a lifter moves up from its said starting position to and beyond the level of the slot in the back wall of the housing, each lifter being adapted to support a coin on edge and being inclined downwardly toward the back of the housing in the upwardly movable reach of the conveyor so that a coin on a lifter may roll down off the lifter through the slot in the back wall of the housing.

18. Coin transfer means as set forth in claim 17 wherein the slots are generally coplanar in a vertical front-to-back plane of the housing and the housing has a guideway therein for guiding coins inserted in the slot in the front wall up to the slot in the back wall, said guideway guiding the coins edgewise generally in said vertical plane of the slots.

19. Coin transfer means as set forth in claim 18 wherein the housing has a coin chute therein inclined downwardly from the slot in its front wall to said guideway.

20. Coin transfer means as set forth in claim 19 having means operable on entry of a coin in the slot in the front wall for operating said lifting means.

21. Coin transfer means as set forth in claim 20 wherein the means operable on entry of a coin in the slot in the front wall comprises means for emitting a beam of light across the guideway to a sensor with the beam being interrupted by a coin rolling down said chute into the guideway.

22. Coin transfer means adapted for use on the front of a vendor for transferring coins from a level within reach of a person seated in a wheel chair to the coin slot of the vendor at a higher level, said transfer means comprising an elongate housing having a front wall and a back wall, a coin slot in the front wall adjacent one end of the housing constituting its lower end, and a coin slot in the back wall adjacent its other and upper end, said housing being adapted to be mounted in generally vertical position on the front of the vendor with the slot in its back wall adjacent its upper end in register with the slot of the vendor, and with the coin slot in its front wall adjacent its lower end at a level within reach of a person seated in a wheel chair, and means in the housing for lifting a coin inserted in the coin slot in the front wall of the housing up to the level of the slot in the back wall of the housing and causing the coin to pass through the slot in the back wall into the coin slot of the vendor, said lifting means comprising means for shooting a coin entered in the slot in the front wall of the housing up to and out through the slot in the back wall of the housing.

23. Coin transfer means as set forth in claim 22 wherein the housing has a deflector therein at the level of the slot in the back wall for deflecting through the latter slot a coin shot upward by said shooting means.

24. Coin transfer means as set forth in claim 23 having means operable on entry of a coin in the slot in the front wall of the housing for operating said shooting means.

25. Coin transfer means as set forth in claim 23 wherein the slots are generally coplanar in a vertical front-to-back plan of the housing and the housing has a guideway therein for guiding coins inserted in the slot in the front wall up to the slot in the back wall, said guideway guiding the coins edgewise generally in said vertical plane of the slots.

26. Coin transfer means as set forth in claim 25 wherein the housing has a coin chute therein inclined downwardly from the slot in its front wall to said guideway.

27. Coin transfer means as set forth in claim 26 having means operable on entry of a coin in the slot in the front wall for operating said shooting means.

28. Coin transfer means as set forth in claim 27 wherein the shooting means comprises a coin impeller extending across the guideway rapidly movable upwardly from a lowered retracted position to impel a coin thereon upwardly in the guideway, and means for rapidly moving the impeller upwardly.

29. Coin transfer means as set forth in claim 28 wherein the impeller comprises a kicker and the means for moving the kicker comprises a solenoid in the housing having a plunger operable on the kicker.

30. Coin transfer means as set forth in claim 29 wherein the guideway has pins for cradling a coin rolling down the chute into the guideway, the kicker, in its retracted position, being below the pins and being adapted to be moved up between the pins to kick the coin.

31. Coin transfer means as set forth in claim 30 wherein the means operable on entry of a coin in said slot comprises means for emitting a beam of light across the guideway to a sensor with the beam interrupted by a coin rolling on the pins.

* * * * *